US006300626B1

(12) United States Patent
Brock et al.

(10) Patent No.: US 6,300,626 B1
(45) Date of Patent: Oct. 9, 2001

(54) TIME-OF-FLIGHT MASS SPECTROMETER AND ION ANALYSIS

(75) Inventors: Ansgar Brock, San Diego; Nestor Rodriguez, Berkeley; Richard N. Zare, Stanford, all of CA (US)

(73) Assignee: Board of Trustees of the Leland Stanford Junior University, Stanford, CA (US)

( * ) Notice: Subject to any disclaimer, the term of this patent is extended or adjusted under 35 U.S.C. 154(b) by 0 days.

(21) Appl. No.: 09/375,080

(22) Filed: Aug. 16, 1999

Related U.S. Application Data

(60) Provisional application No. 60/096,726, filed on Aug. 17, 1998.

(51) Int. Cl.[7] ..... H01J 49/40

(52) U.S. Cl. ..... 250/287

(58) Field of Search ..... 250/287, 286, 250/281, 282

(56) References Cited

U.S. PATENT DOCUMENTS 4,707,602 * 11/1987 Knorr ..... 250/287
5,396,065 3/1995 Myerholtz et al. ..... 250/287

OTHER PUBLICATIONS

"The New Time–of–flight Mass Spectrometry," R.J. Cotter, *Analytical Chemistry News & Features*, Jul. 1, 1999, pp. 445 A—461 A.

"Fourier Transform Ion Mobility Spectrometry," F.J. Knorr et al., *Analytical Chemistry*, vol. 57, No. 2, Feb. 1985, pp. 402–406.

"Beam compression and beam multiplexing in a time–of–flight mass spectrometer," I. Riess, *Rev. Sci. Instrum.*, vol. 58, No. 5, May 1987, pp. 785–787.

"Fourier Transform Time–of–Flight Mass Spectrometry," F.J. Knorr et al., *Analytical Chemistry*, vol. 58, No. 4, Apr. 1986, pp. 691–694.

A miniature time of flight mass spectrometer, C.A. Bailey et al., *Vacuum*, vol. 21, No. 10, Jul. 19, 1971, pp. 461–464.

"Hadamard Transform Time–of–Flight Mass Spectrometry," A. Brock et al., *Analytical Chemistry*, vol. 70, No. 18, Sep. 15, 1998, pp. 3735–3741.

"On the origin of spurious peaks in pseudorandom time–of–flight analysis," P. Zeppenfeld et al., *Rev. Sci. Instrum.*, vol. 64, No. 6, Jun. 1993, pp. 1520–1523.

"Use of a Correlation Chopper For Time of Flight Neutron Scattering(*), Part I: Theory of the Deconvolution," J.L. Buevoz et al., *Revue de Physique Appliquée*, vol. 12, Apr. 1977, pp. 591–596.

"Use of a Correlation Chopper For Time of Flight Neutron Scattering(*), Part II: Deconvolution in the Experimental Case," J.L. Buevoz et al., *Revue de Physique Appliquée*, vol. 12, Apr. 1977, pp. 597–602.

* cited by examiner

*Primary Examiner*—Kiet T. Nguyen
(74) *Attorney, Agent, or Firm*—Skjerven Morrill MacPherson LLP; James S. Hsue

(57) ABSTRACT

An ion beam supplied from a source is modulated so that ions at a constant flux is passed during on periods or portions thereof and are deflected or stopped during off periods according to a binary sequence in order to encode the ion beam with phase information of the sequence. The binary sequence is such that ions released during two consecutive on periods overlap before reaching a detector, thereby increasing the duty-cycle. The detector output signal is demodulated using the phase information of the binary sequence to recover an ion mass spectrum.

32 Claims, 13 Drawing Sheets

TIME-OF-FLIGHT MASS SPECTROMETER AND ION ANALYSIS

CROSS REFERENCE TO RELATED APPLICATION

This application is a continuation-in-part of provisional U.S. patent application Ser. No. 60/096,726, filed Aug. 17, 1998.

BACKGROUND OF THE INVENTION

This invention relates in general to time-of-flight mass spectrometers and in particular to time-of-flight mass spectrometers.

Time-of-flight ("TOF") analysis has found widespread application because particle velocity, momentum, and mass can be determined from an experiment by constraining the appropriate parameters for the experiment. Time-of-flight mass spectrometers ("TOFMSs") have the very desirable characteristic of high ion transmission, high repetition rate, good resolution and modest cost, which makes them very attractive as a mass sensitive detector in analytical instrumentation. Such applications were until recently somewhat hampered by the fact that most analytical ion sources produce continuous ion beams. The pulsed operation of a conventional TOFMS causes a rather low duty-cycle and TOFMS could not live up to its promises. For more detailed description of the state of the art of TOFMS, please see "The New Time-Of-Flight Mass Spectrometry," by Robert J Cotter, *Analytical Chemistry News and Features*, Jul. 1, 1999, pages 445A–451A.

It is desirable for an interface design between a continuous ion source and a TOFMS to overcome two problems. One is bringing the ions with as little spatial and kinetic energy spread as much as possible into the spectrometer for the purpose of achieving high mass resolution. The other is using as many of the ions supplied by the continuous source as possible without compromising on the first requirement so that a high duty-cycle can be achieved. Today, the preferred and highly refined solution to these problems is orthogonal acceleration ("OA"). See "Time-of-Flight Mass Spectrometry," R. J. Cotter, *ACS Symposium Series* 547. By OA, it is meant that the ion beam emanating from the ion source enters the TOF instrument at right angle with respect to the flight axes of the ions in the spectrometer. This geometry allows a low spatial and kinetic energy spread to be achieved. The duty-cycle objective is met by expanding the width of the extraction region so that a larger fraction of the ion beam coming from the source can be sampled. Active ion storage can be achieved by accumulation of ions in an ion guide connecting ion source and extraction region during the time an extracted ion packet disperses in the instrument.

In U.S. Pat. No. 5,396,064, Myerholtz et al. describe a multiplexing procedure using a conventional TOF instrument in which an extraction region involving a pair of grids is pulsed and a cross-correlation is carried out numerically. This scheme, however, is still seriously impaired in practice by the difficulty of implementing a procedure using a pair of grids and parameters allowing for space focusing. A conventional space-focusing type of TOFMS is difficult to operate in a full multiplexing mode over an extended mass range. The pair of grids cannot be pulsed sufficiently rapidly to accomplish this objective because of the time it takes for ions to drift into the region between the grids. Moreover, this drift, of course, is mass dependent. For this reason, space focusing, which requires an extraction region defined by more than one grid, is undesirable.

None of the above-described TOFMS schemes are entirely satisfactory for measuring ions. It is therefore, desirable to provide an improved TOFMS technique where the above-described difficulties are avoided.

SUMMARY OF THE INVENTION

A continuous beam of ions is modulated so that the beam is passed substantially unaltered during on periods or portions thereof but is affected during off periods according to a binary sequence to encode the beam with phase information of the binary sequence. When the beam is passed substantially unaltered, the beam has a substantially constant flux. The ions in the beam reach a detector where the times of arrival of the ions in the modulated beam are detected. The output signal of the detector is demodulated using the phase information to obtain an ion mass spectrum.

In one embodiment, during the off periods, the beam is deflected so that it does not reach the detector or reaches a different area of the detector. This may be accomplished by deflecting the beam during the off periods electrically. Alternatively, the beam can be simply stopped during off periods but let through during the on periods, such as by means of a mechanical chopper. Still other possible modulation techniques may be used, such as a separate particle or photon beam which would deflect or otherwise interrupt the beam during off periods but leave the beam substantially unaltered during on periods.

Since the beam is first encoded according to a binary sequence and the detector output demodulated using phase information from the sequence, and ions from consecutive on periods may overlap, it is possible to achieve a duty cycle close to or equal to 50%. Furthermore, since the beam that is passed during the on periods has substantially constant flux, the demodulation process is simple and can be achieved quickly, unlike conventional modulation and demodulation schemes such as the Fast Fourier Transform.

It is also possible to deflect the beam during off periods towards a detector different from that used for detection during the on periods or to a different active area of the same detector. This can improve the duty-cycle to 100% or close to it.

Preferably, multiple TOFMS may share a common modulator and chamber housing the different ion beams to reduce space and cost.

BRIEF DESCRIPTION OF THE DRAWINGS

FIG. 1(*b*) illustrates the mathematical entities that are used in the method of FIG. 1(*a*).

FIG. 2(*a*) is a timing diagram of ion flux in the modulated ion beam achieved using the binary sequence of FIG. 2 to illustrate one embodiment of the invention in a gate mode type of operation.

FIG. 2(*b*) is a timing diagram of ion flux in the modulated ion beam achieved using the binary sequence of FIG. 2 to illustrate another embodiment of the invention in a differential impulse sweep mode type of operation.

FIG. 2(*c*) is a timing diagram of ion flux in the modulated ion beam achieved using the binary sequence of FIG. 2 to illustrate data obtained in an actual experiment in a differential impulse sweep mode type of operation.

FIG. 5(*b*) is the mass spectrum of pure argon ion beam obtained by demodulating the signal waveform of FIG. 5(*a*) using phase information from the binary sequence used to modulate the argon dimer ion beam in FIG. 5(*a*).

FIG. 6(*b*) is a graphical plot of a beam image obtained with a pseudorandom modulation voltage applied to the grid modulator of FIG. 3 in a differential impulse sweep mode.

FIG. 8(*b*) is a graphical plot of the mass spectrum obtained at different modulation voltages in a differential impulse sweep mode.

FIG. 9(*b*) illustrates a mass spectrum of reserpine recorded at beam energy of 250 eV with different sampling bin widths operated in a gate mode.

For simplicity in description, identical components are labeled by the same numerals in this application.

DETAILED DESCRIPTION OF THE PREFERRED EMBODIMENT

The preferred embodiment of this invention employs a multiplexing scheme for modulating and demodulating a beam of ions based on Hadamard difference sets as known in optical spectroscopy under the name of Hadamard spectroscopy. The mathematical procedures for actually carrying out the inverse transform of a signal waveform by fast Hadamard transform ("FHT") may be more easily understood by reference to *Hadamard Transform Optics*, M. D. Harwit and N. J. Sloane, Academic Press, London, 1979, which discusses optical techniques.

FIG. 1(*a*) is a flow chart illustrating a method as applied to the TOFMS of this invention. First a continuous ion beam is produced (block 22). This beam is modulated in an on/off fashion (block 24). The mathematical entities that are applied in the flow chart of FIG. 1(*a*) is illustrated in FIG. 1(*b*). Mathematically, the modulation applied in block 24 is described by sequence 24*a* of elements $a_i$, that are either 1 or 0. This sequence of 0's and 1's (binary sequence) used for modulation is logically chosen in such a way to minimize the error in the TOF distribution to be determined.

Figures 1A, 1B:
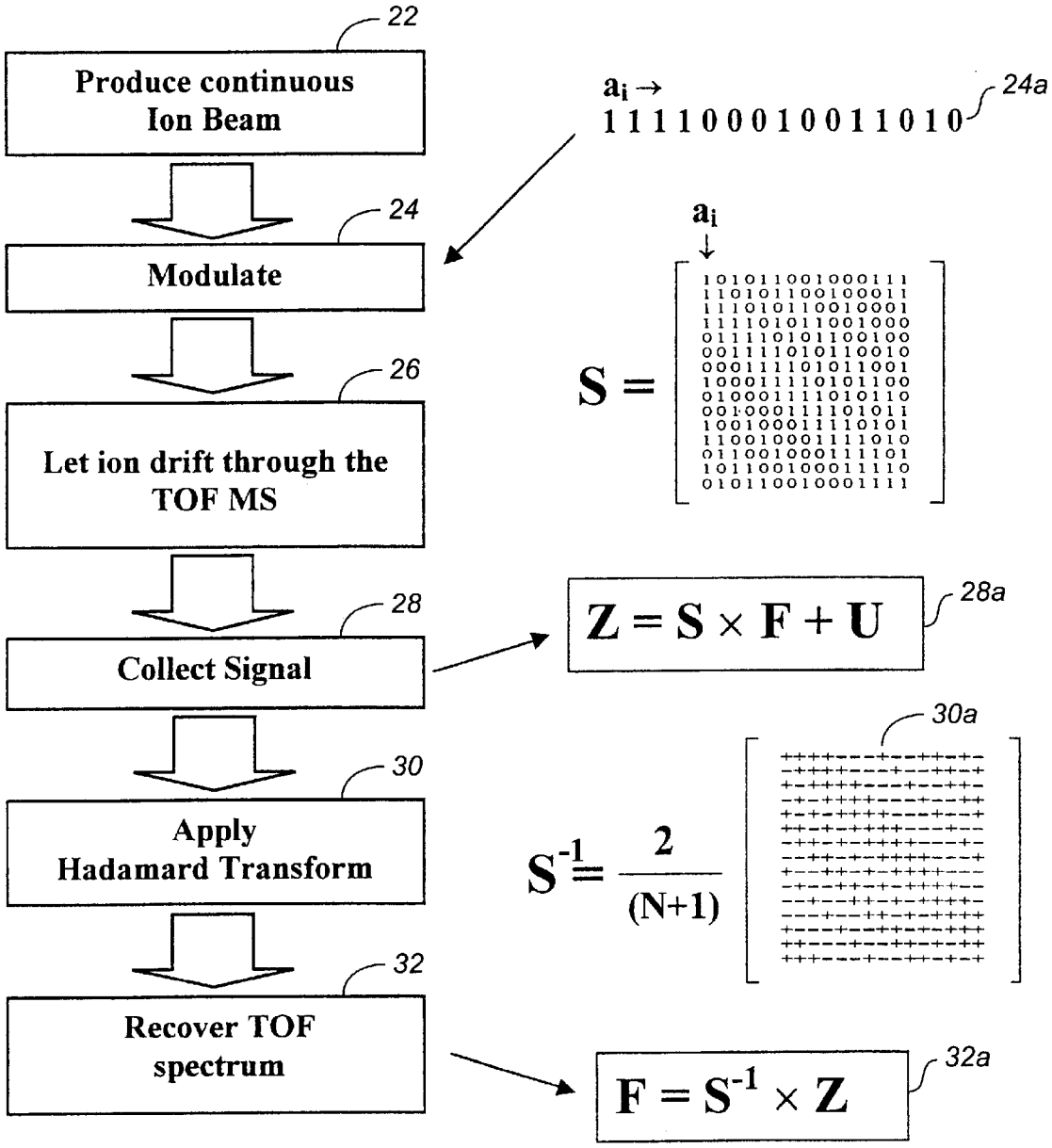
FIG. 1(*a*) is a flow chart illustrating the TOF method of this invention.
Figures 2A, 2B, 2C:
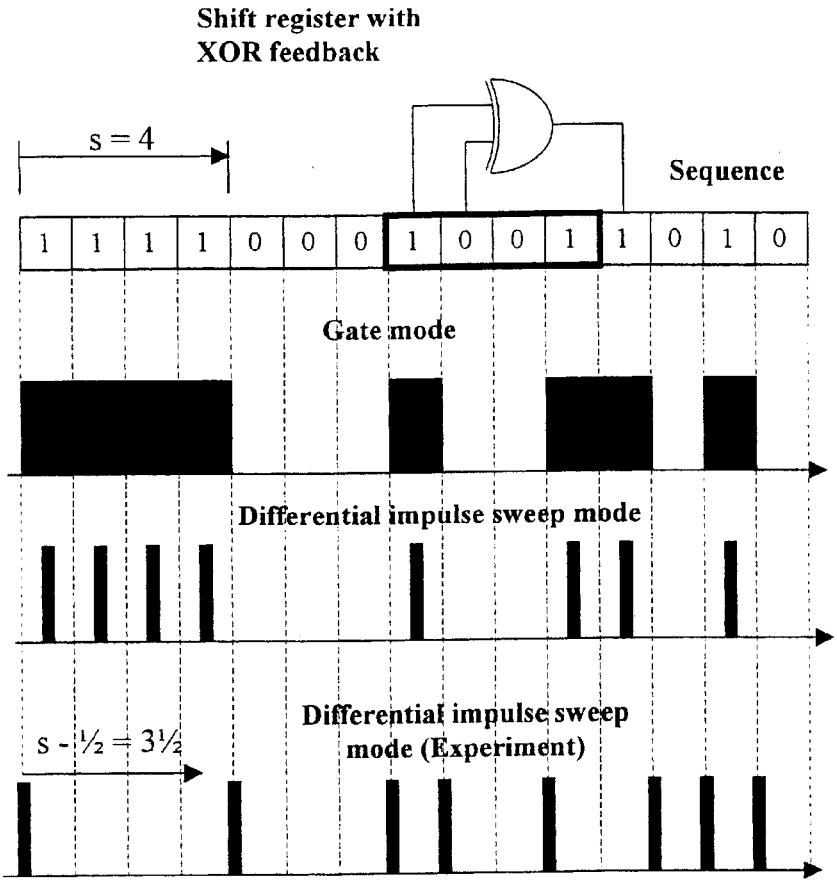
FIG. 2 is a schematic view of a shift register with (exclusive logical or) XOR feedback and a binary sequence that may be used for modulating the ion beam in FIGS. 1(*a*) and 1(*b*) to illustrate the invention.

A single 1 in the sequence corresponds to turning the beam on for one time unit, which is also the time resolution of the device, and a single 0 in the sequence corresponds to turning the beam off for one time unit; using this convention, the ion beam flux resulting from the binary sequence 24*a* in FIGS. 1*b* and 2 is illustrated in FIG. 2*a*. Alternatively, a single 1 in the sequence may also correspond to turning the beam off for one time unit, and a single 0 in the sequence corresponds to turning the beam on for one time unit. This time unit may also be the bin width in which the signal is usually sampled; as noted below, each time unit may be divided into a number of bins during which the signal is separately sampled, in which case each bin would occupy only a fraction of the time unit.

The binary sequence 24*a* in FIG. 1(*b*) is also illustrated in FIG. 2 associated with a shift register with XOR feedback for generating the sequence. FIG. 2(*a*) illustrates the ion flux resulting from using the binary sequence 24*a* of FIGS. 1*b*, 2 to modulate an ion beam, such as a continuous beam of constant flux in the gate mode. Thus, the ion beam may be modulated by means of the binary sequence in FIG. 2 for turning on or off the ion beam. Therefore, if the value 1 in the binary sequence indicates that the ion beam should be passed to the detector, the value 0 means that the ion beam should not be passed to the detector. Unlike the conventional TOFMS, one does not need to wait until an ion packet has traversed the entire path between the source and the detector before the next ion packet is released. Instead, the faster moving ions which are passed later may overtake the slower moving ions passed earlier. By the demodulation process described below, ions passed at different times may be distinguished. In this manner, a duty-cycle of 50% or a value close to it may be achieved.

In reference to FIG. 1(*a*), the modulated ion beam is allowed to drift through the TFMOS to the detector (block 26) and the detector provides an output signal in response to the modulated ion beam (block 28). The Hadamard inverse transform is then applied to the output signal of the detector (block 30) using matrix 30*a* ($S^{-}$) and the TOF mass spectrum is recovered (block 32). As shown in FIG. 1(*b*), a correlation matrix S may be formed by using the binary sequence 24*a* and the first column of the matrix and subsequent binary sequences as subsequent columns in the correlation matrix S. The output signal Z of the detector is given by equation 28*a* where the product of the matrix S and the mass spectrum vector F of the ion beam is added to a background signal U. The inverse transform $S^{-1}$ is given by equation 30*a* in FIG. 1(*b*) and may be obtained by replacing all zeros in S by −1/k and all ones by 1/k, where k is the number of 1's in the pseudorandom sequence applied altogether (namely, all of the sequences, such as sequence 24*a*). In practice, it is not even necessary to construct the desired pseudorandom sequences from Hadamard difference sets. Maximum length pseudorandom sequences ("MLPRS") are readily generated by feedback shift register circuitry. See for example, *Hadamard Transform Optics*, M. D. Harwit and N. J. Sloane, Academic Press, Long, 1979 and *Fourier Transforms in NMR, Optical and Mass Spectrometry*, A. G. Marshall and F. R. Verdun, Elsevier, Amsterdam, 1990. The ion mass spectrum of the ion beam may then be recovered by equation 32*a* in FIG. 1(*b*).

As noted above, FIG. 2 illustrates a binary sequence that may be used in a Hadamard transform modulation and demodulation of the ion beam in the preferred embodiment of this invention. In FIG. 2(*a*), gate mode operation is illustrated, where the beam is turned on and off for the whole duration of a 1 in the sequence as illustrated in FIG. 2(*a*). The sampling in the output signal of the detector may be done in integer fractions of a time unit to be able to recover the spectrum. The largest allowed sampling bin is therefore, one time unit. Sampling of the signal waveform into bins of integer fractions of the unit time means that a corresponding increase needs to be made in the total number of sampling bins to cover the whole waveform. The recovery of F from the recorded signal Z after the sampling in bins smaller than the maximum size means that the inverse transform of the signal be carried out in sets of every second, third, or whatever multiple that was used in increasing the sampling density. After transformation, the individual sets are again interspersed to form the TOF dispersion F. This procedure will increase the definition of individual peaks, but is not able to increase the time or mass resolution of the device.

Short ion packets are readily produced by use of transient effects, namely, the sweeping of the beam over a slit. The resulting transient or pulse is usually much shorter than the time necessary to repeat it so that the duty-cycle is less than 50% achieved in the gate mode. Nevertheless, the duty-cycle can still be comparatively high and the analysis of the data is essentially unchanged as shown in FIG. 2(*b*). Higher time resolution from the shortened pulses can be seen in the final spectrum if the sampling beam width is reduced to at least a transient pulse width, which is smaller than the unit time element of the sequence. The signal waveform is sampled as described above when increasing the peak definition in the gate mode. In other words, sampling needs to take place in the bins of integer fractions of the unit time element of the logic sequence and the total number of sampling bins to cover a full cycle of the waveform is increased proportionally. Recovery off from the recorded signal Z, is achieved by carrying out the inverse transform of the proper sub-sets of bins by an interspersion after transformation.

The invention may also be conducted in a different mode known as the differential impulse sweeping mode, which is accomplished by inversion of the potentials applied to the elongated conductors or wires in the modulator so that a short pulse is produced at any 0 to 1 or 1 to 0 transition in the logic sequence as would be apparent from FIGS. 2 and 2(*c*). The mathematical properties of MLPRS's produced through a shift registered generation, means that the modulation sequences of FIGS. 2(*a*) or 2(*b*) and that of 2(*c*) are identical, so that they only look different because a phase shift has been introduced. This result is shown in P. Zeppenfeld, M. Krzyzowski, C. Romainczyk and R. David, *Rev. Sci. Instrum.* 64, 1520(1993) and J. L. Buevoz and G. Roult, *Rev. Phys. Appl.* 12, 597(1977). Therefore, the TOF distribution can be recovered with the same FHT that is used to recover the spectrum modulated in a fashion like that shown in FIGS. 2(*a*) and 2(*b*) in the gate mode except that a correction for the phase shift needs to be made either before or after that transformation.

Figure 3:
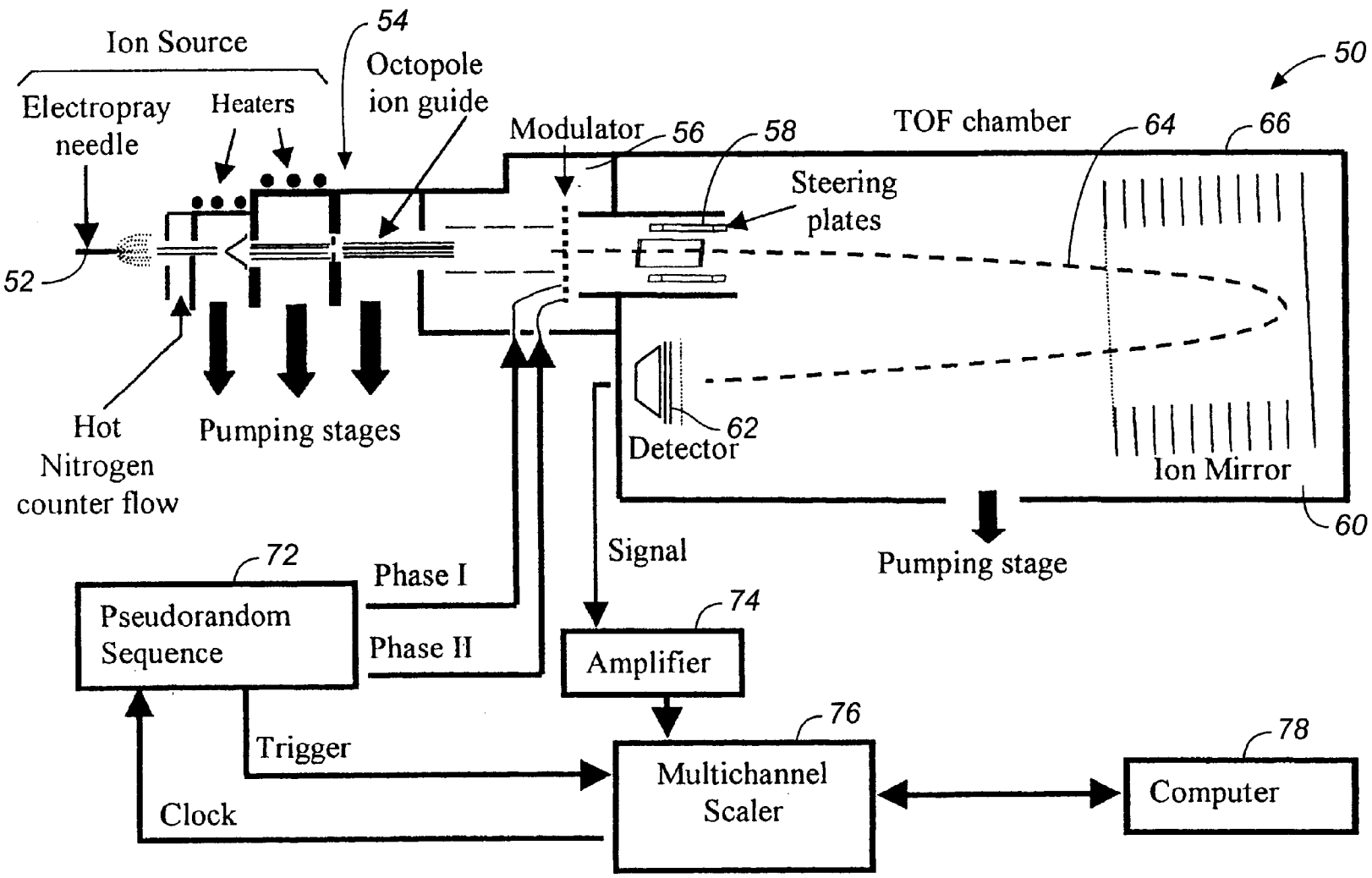
FIG. 3 is a block diagram of a TOFMS apparatus to illustrate the preferred embodiment of the invention.

FIG. 3 is a block diagram of a TOFMS system to illustrate the preferred embodiment of the invention with an electrospray ionization source. In this case, ions supplied by an electrospray needle 52 are passed through pumping stages equipped with heaters, a hot nitrogen counter flow and octopole ion guide. Ions are accelerated after the ion guides and before reaching a modulator 56 comprising an array of elongated electrical conductors (such as a linear array of wires). Preferably the conductors are arranged in a plane orthogonal to the direction of the ion beam emanating from the pumping stages 54. After passing through the modulator 56, the parallel beam is steered, with the help of two sets of deflection plates 58, through the ion mirror 60 and onto the detector 62.

A number of different schemes may be used to implement the binary sequences of FIGS. 2–2(*c*). Different from the prior art scheme in the patent to Myerholtz et al. described above, when the ion beam is passed by the modulator 56, ions from the beam from pumping stages 54 are simply let through substantially without being altered. These ion beam segments of substantially constant flux are reflected by mirror 60 to reach a designated active area of detector 62 to generate the detector output signal Z. In other words, during the on periods of the modulator 56, ions of constant flux are passed to the detector.

The modulation of the ion beam during the off periods may be accomplished in a number of different ways. Thus, the ion beam may be deflected so that it no longer follows the same trajectory to the designated area of the detector 62; instead, after deflection by the modulator 56 during the off periods, the ion beam will land on an area of the detector different from the designated area so that such ions are either not counted or counted separately. If the ions are not counted, a 50% duty-cycle is achievable. If the ions during the off periods are also counted but separately from the ions counted during the on periods, a duty-cycle of 100% may be achievable. The above-described designated area of the detector may be achieved by putting a spatial filter having a slit therein in front of the detector so that only the designated area of the detector is exposed to the ion beam. For simplicity, such filter is not shown in FIG. 3.

Modulator 56 may be implemented by means of a mechanical chopper which lets through the ion beam of constant flux when the chopper is open but would stop all of the ions from getting through in the off periods. In the preferred embodiment, however, modulator 56 includes a linear array of elongated electrical conductors to which appropriate electrical potentials are applied to control the on and off periods. During the on period, in one embodiment, all of the electrodes are at substantially the same potential so that the ions are not deflected thereby and will proceed as if in the absence of the modulator to the ion mirror 60 and to the designated area of the detector 62. Ii however, the potentials of the electrical conductors are at different electrical potentials, this may cause the ion beam to be deflected, thereby causing the ions in the beam to land outside the designated area of the detector or in a different active area of the detector as described above in the off periods.

The gating mode operation may be achieved by keeping the potential of every other (i.e. even numbered or odd numbered where the linear array of electrodes is numbered consecutively) elongated electrode in the array at the same constant potential and toggling the potential of the remaining electrodes or conductors between such constant potential and a different potential. In the preferred embodiment for the gate mode, such toggling is performed during the off periods so that adjacent electrodes or conductors are at potentials of opposite polarity but of equal magnitude, so that such off potentials applied to the electrodes or conductors will not affect the on coming ions in the ion beam at a distance which may be passed during a subsequent on period. In other words, since adjacent electrodes in the array have equal but opposite potentials, at a distance, the on coming ions in the ion beam would experience no net electric field so that an off period would not adversely affect the path of ions during a subsequent on period; this increases the accuracy of the measurement.

In the above-described scheme, if every other electrode is kept at 0 V, in a gate mode, the remaining electrodes will be toggled between 0 V and a potential different from 0 V. If, however, the remaining electrodes are toggled not between 0 V and a different potential but between −1 V and +1 V, then there is a brief time period during the transition when all of the electrodes are at 0 V. It is only at such instance that ions are let through which would define the on periods. During the time outside such on periods, the electrodes or conductors would be at different potentials so that ions in the ion beam would be deflected and will not reach the designated area of the detector; such times would be defined as the off periods of the device. This operation is equivalent to sweeping a beam across a slit and is, therefore, referred to as the differential impulse sweep mode. It is, of course, also possible to toggle both sets of electrodes between two different potentials but in opposite phase. Thus, the odd numbered electrodes or conductors in the linear array may be toggled between −1 and +1 volt and the even-numbered electrodes in the array may be toggled between +1 and −1 V so that when the odd-numbered electrodes are at −1 volt, the even-numbered electrodes are at +1 volt and vice versa. Other methods for implementing the gate and differential impulse sweep modes are possible and are within the scope of the invention.

The steering plates 58, ion mirror 60, detector 62 and the path of the ions 64 are enclosed by a TOF chamber 66. The above-described pseudorandom binary sequence is generated by a generator 72 and appropriate voltages corresponding to the sequence are applied to the set of wires in modulator 56; for simplicity, the connections from generator 72 to only two of the wires in the linear array in modulator 56 are shown in FIG. 3. The multi-channel scaler 76 supplied a clock signal to generator 72, which, in turn, supplies a trigger signal to the multi-channel scaler 76 to signal the start of the sequence. Multi-channel scaler 76 counts, by the amplified output of the detector 62 by amplifier 74 into time bins of integral fraction of the unit time. Such counts are then sent to a computer 78 for performing the calculations of FIG. 1(*b*) in order to derive the ion mass spectrum. While a computer is used for this purpose, it will be obvious that other types of electronic circuits for processing the data may be used and are within the scope of the invention. Generator 72 and multi-channel scaler 76 may be constructed in a conventional manner as known to those skilled in the art and will not be described in detail here.

Figure 4:
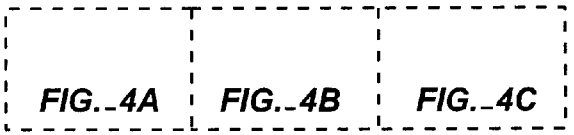
FIGS. 4(*a*), 4(*b*) and 4(*c*) are schematic circuit diagrams of a shift register circuit to illustrate the generation of a pseudorandom binary sequence that may be used for modulating an ion beam in the apparatus of FIG. 3.
Figure 4A:
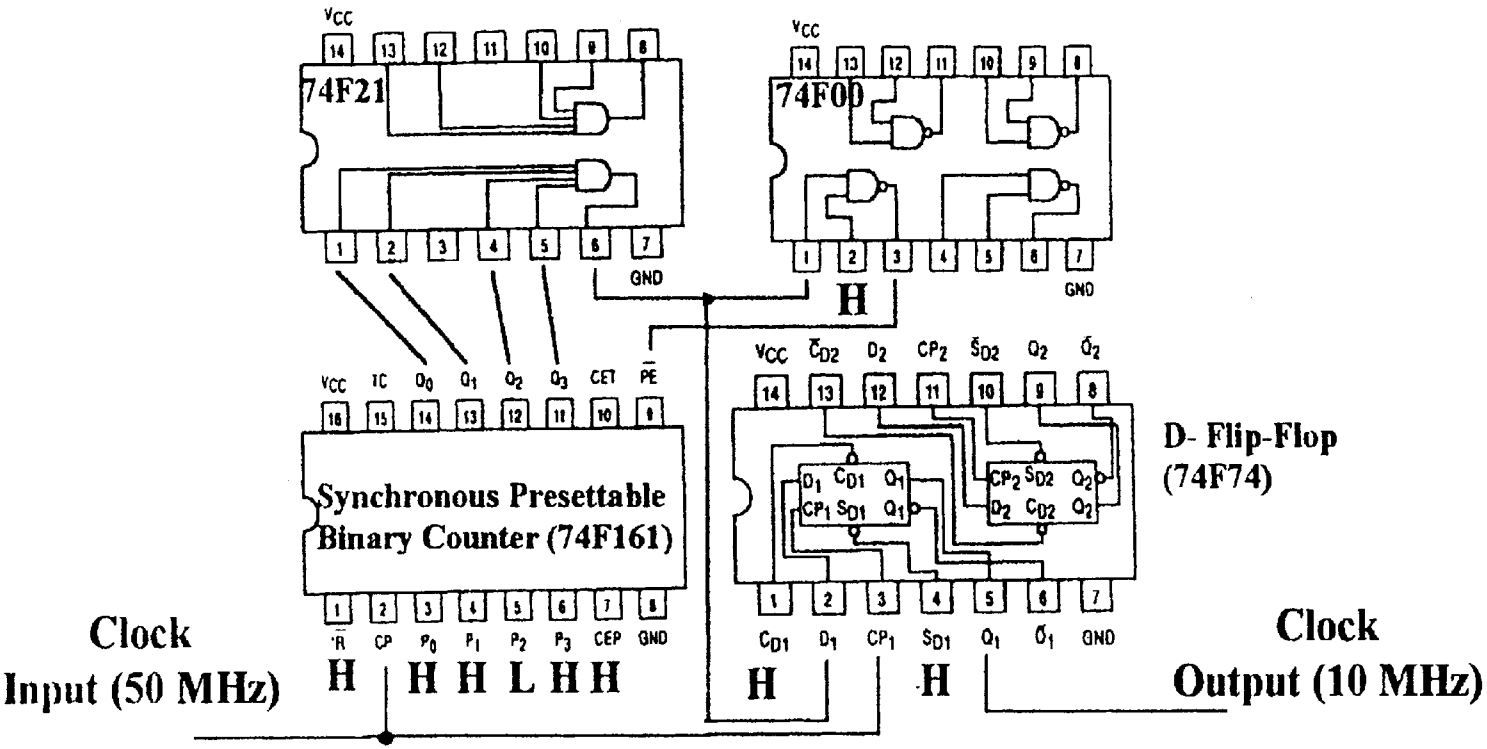
Figure 4B:
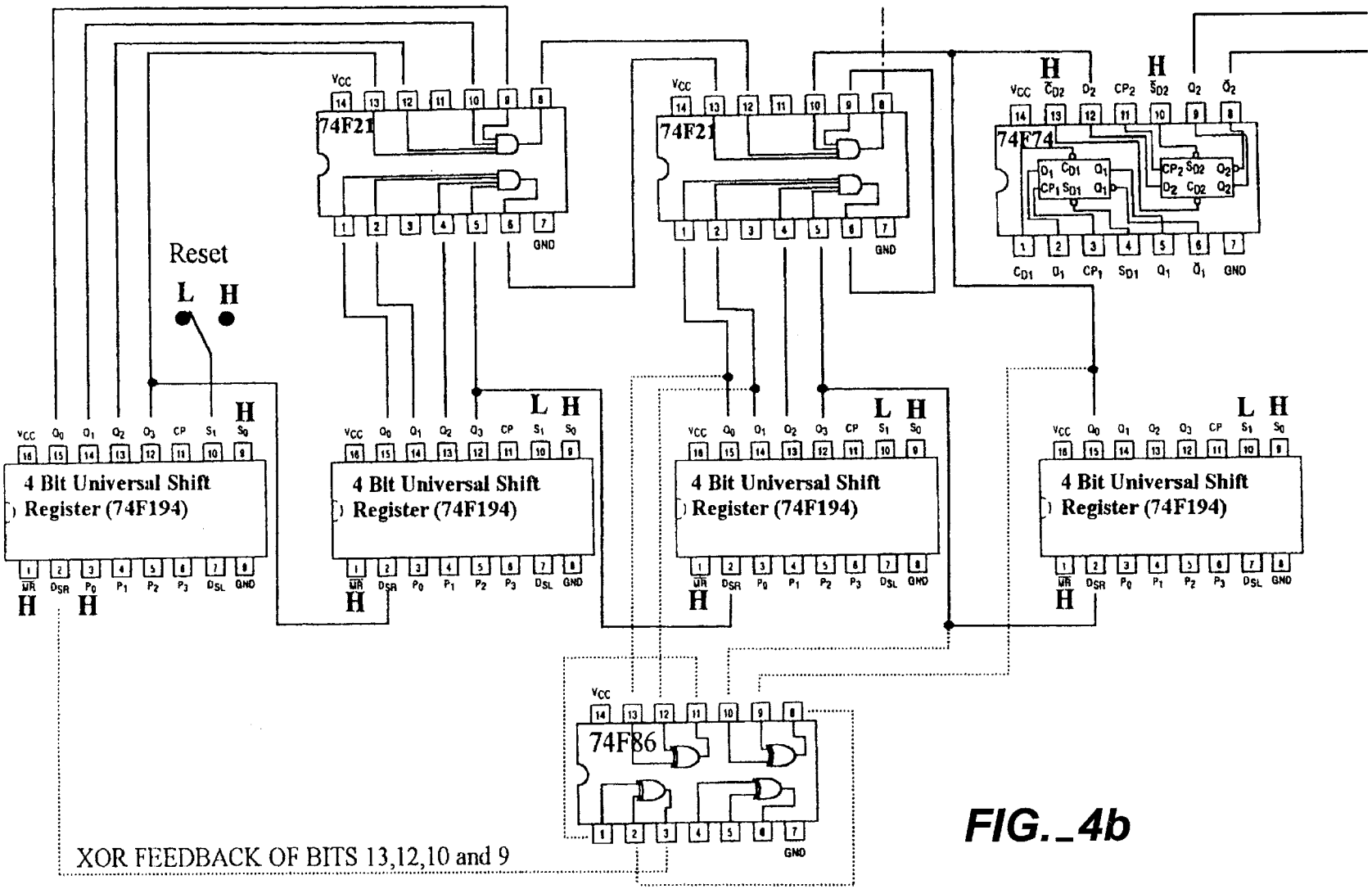
Figure 4C:
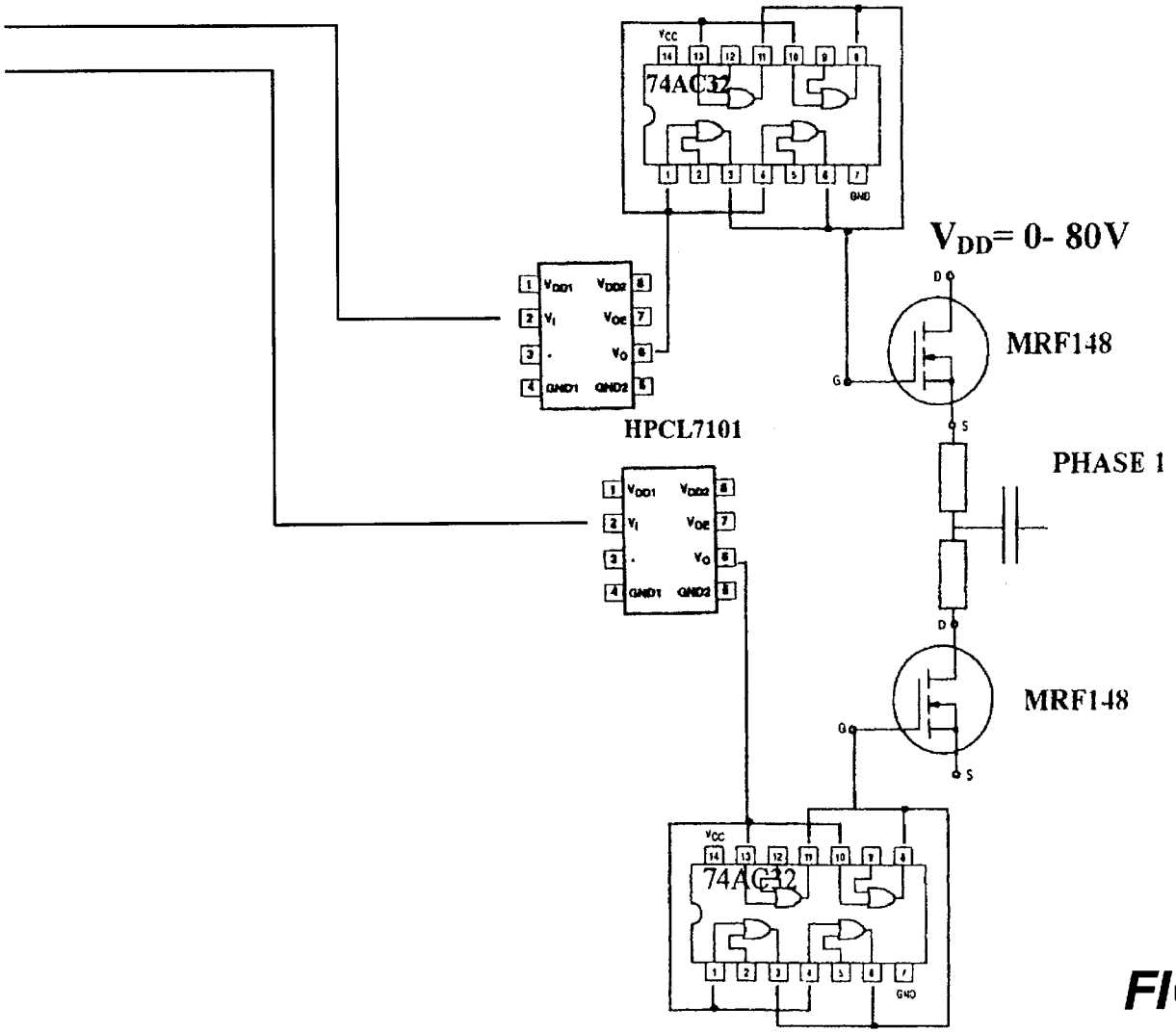

Generator 72 contains a shift register circuit illustrated in FIGS. 4(*a*), 4(*b*) and 4(*c*) which generate a pseudorandom binary sequence described in more detail in the appendix attached, entitled "Characterization of a Hadamard transform time-of-flight mass spectrometer," by Ansgar Brock, Nestor Rodriquez and Richard N. Zare.

While preferably and as shown in FIG. 3, the modulator comprises a linearly array of elongated electrical conductors or electrodes for controlling the passing and deflection of the ion beam, other configurations of the elongated conductors are possible, such as electrodes arranged on two separate planes. Such and other variations are possible and are within the scope of the invention.

Figure 5A:
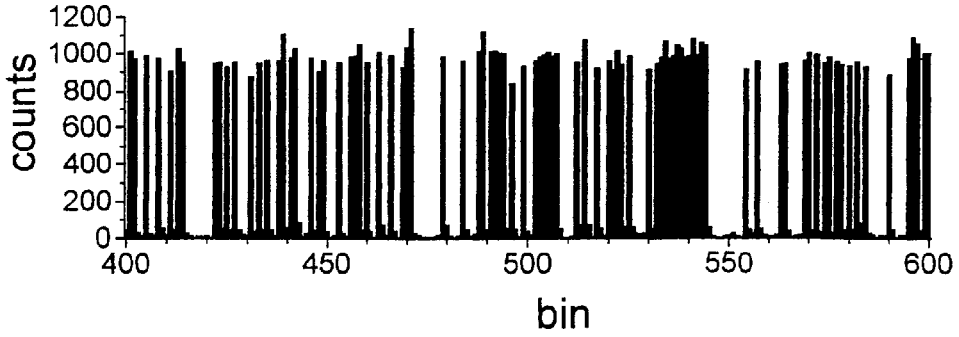
FIG. 5(*a*) is a graphical plot of a signal waveform of an output signal of the detector of FIG. 3 illustrating the detector output signal obtained when a pure argon dimer ion beam is modulated using a binary sequence.
Figure 5B:
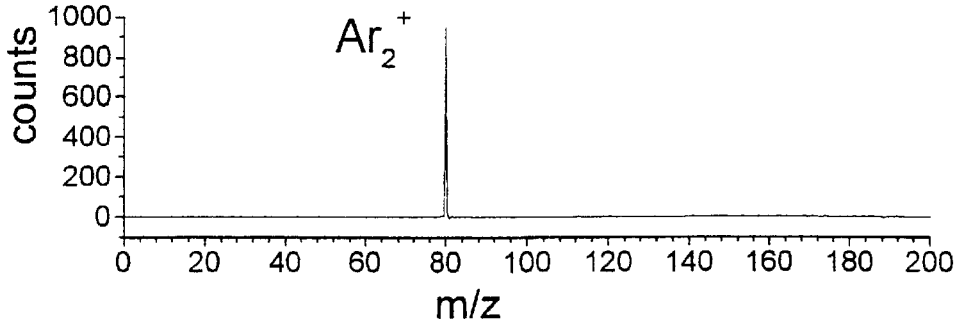

The waveform in FIG. 5(*a*) was counted into 100 nanosecond bins, which was the unit time interval used for modulating the beam in the gate mode. For an ion beam of a single species, the signal waveform should reproduce the modulation waveform with some time shift depending on the mass-to-charge ratio of the ion. This behavior is clearly observed in FIG. 5(*a*). Some bins contain approximately 1,000 counts whereas others contain almost no counts; the former corresponding to a 1 (beam on state) and the later to a 0 (beam off state) of the modulation sequence. Further, bin number 537 starts a series of 13 bins of which all correspond to 1's in the modulation sequence. The modulation sequence contains only a single sequence of 1's of length 13. This sequence will be clocked out of the shift register as soon as all of its bits are in the 1 state. This state of the register is the one decoded to produce the data acquisition start trigger. Therefore, the flight time of the ions through the instrument must be 537×100 nanoseconds or 53.7 microseconds. The resolution at this mass can be computed to be 268.5.

Figure 6A:
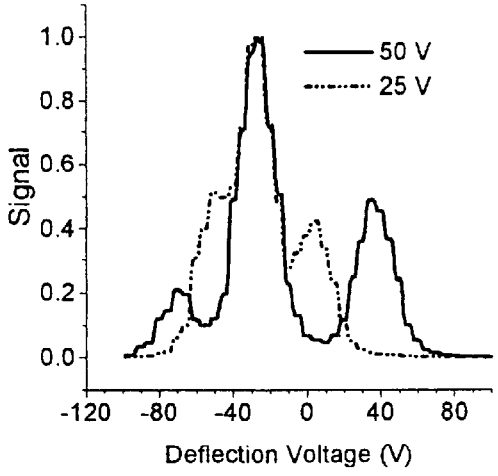
FIG. 6(*a*) is a graphical plot of a beam image acquired with the pseudorandom modulation voltages applied to the grid modulator of FIG. 3 as a function of the deflection voltage in a gate mode.
Figure 6B:
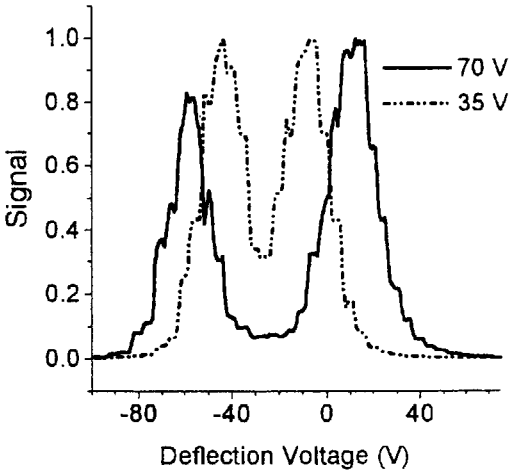

FIGS. 6(*a*) and 6(*b*) show the beam images acquired with pseudorandom modulation voltages applied to the grid modulator 56. Again, an argon ion beam is used to produce the images. The images are acquired by scanning the deflection voltage applied to the vertical deflection plate 58 from −100 V to 100 V at an ion beam energy of 1250 eV. The ion signal was counted into 1 second bins and the deflection voltage was stepped manually every 5 seconds by 5 V, which causes the step structure of the images.

The image acquired in gate mode operation is shown in FIG. 6(*a*) for two modulation voltages. At a deflection voltage of −30 V, the feature from the undeflected beam is seen. A feature of about half this intensity is seen around a deflection voltage of 5 V and 35 V for the modulation voltages of 25 and 50 V, respectively and corresponds to one of the expected deflected bands. For small deflection angles, a proportionality exists between the deflection voltages applied to the modulator 56 and the ones applied to the beam steering plates 58. This behavior implies that the deflection voltage scales in FIGS. 6(*a*) and 6(*b*) can be directly mapped into a deflection angle scale. At the 1250 eV beam energy, using a deflection voltage change of 40 V corresponds to a change in deflection angle of about 1°. This proportionality is clearly seen in FIG. 6(*a*) where doubling of the modulation voltage also requires doubling of the deflection plate voltage. The second band arising from the deflected beam at more negative deflection voltages then the undeflected feature appears with an intensity considerably lower than expected and at a distance smaller than the one at the higher deflection voltage due to some misalignment in the experiment. Using such information, another area of detector 62, or a separate detector surrounded detector 62, may be used for detecting the ions and the deflected ion beam so as to achieve a duty-cycle of close to 100%.

FIG. 6(*b*) shows time-averaged beam images for operation in differential impulse sweep mode. As expected, two features of equal intensity appear corresponding to the deflected beams. The undeflected beam appears at a drop between the two features and corresponds to a deflection voltage of −30 V.

Figure 7:
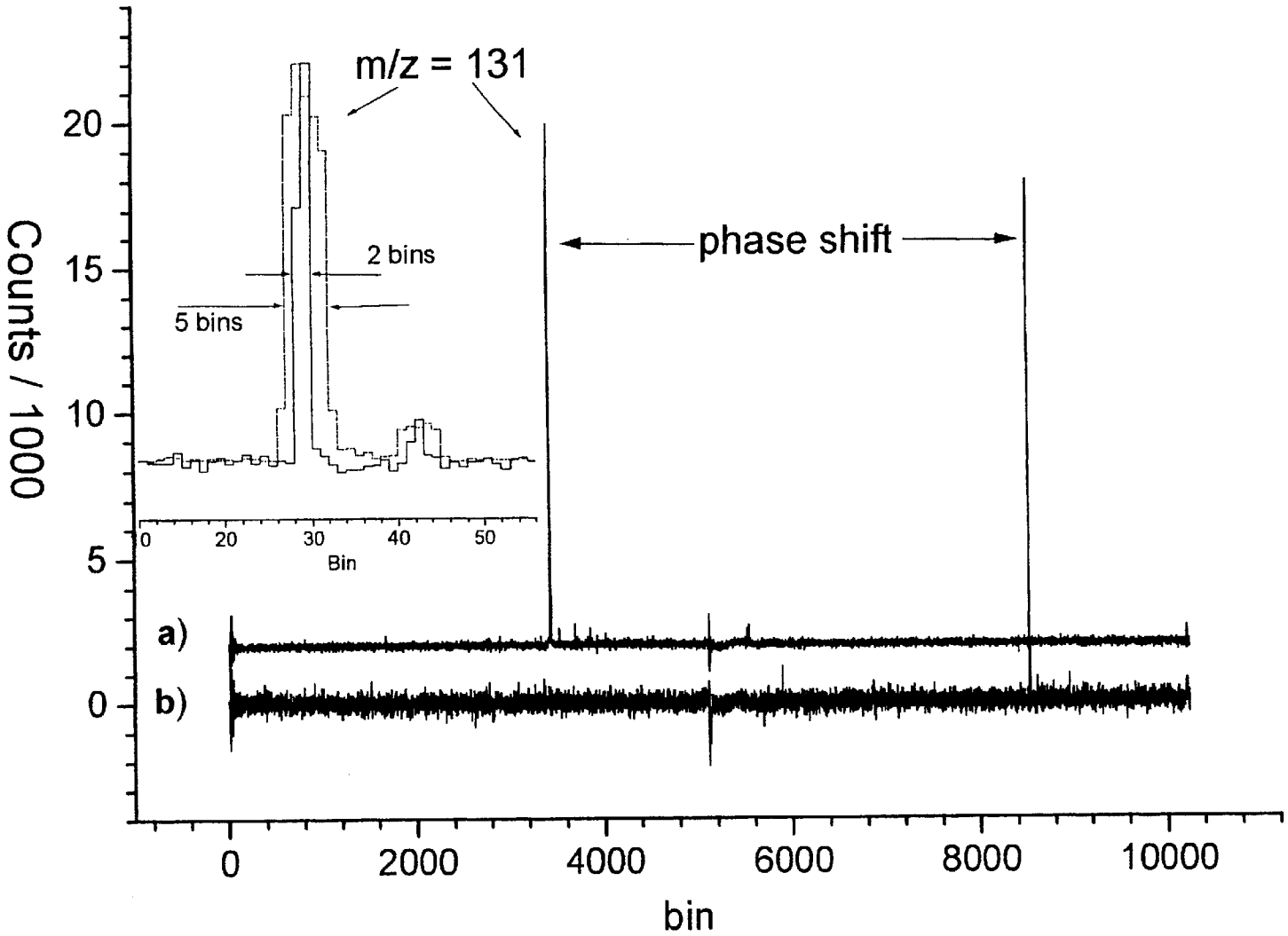
FIG. 7 is a graphical plot of experimental data obtained in the gate mode and the differential impulse sweep mode to illustrate the preferred embodiment of the invention.

FIG. 7 is a graphical plot of data illustrating the differences between gate mode and differential impulse sweep mode. The offset trace (a) showing a peak at bin 3424 was recorded in gate mode operation whereas the trace (b) showing a feature at bin 8517 was recorded in differential impulse sweep mode. Both are positive-ion electrospray ionization spectra of tetraethylammonium bromide from a $1.6\times10^{-5}$M solution in methanol. The modulation sequence was based on a 10-bit generator, which produces a sequence of length 2047. The circuit was clocked at 10 MHz, which resulted in a 100 nanosecond unit time interval of the modulation sequence. The signal waveform was counted into 20 nanosecond bins so that five acquisition bins were used to cover a unit time interval. Therefore, the total length of the spectrum was 10235 bins as shown in FIG. 7. The inverse transform of the signal waveform was carried out in the manner described above using 5 sets of 2047 bins. The beam energy was 1250 eV for these experiments, and the deflection voltage was 70 V for differential impulse sweeping and 35 V in gate mode. The phase shift occurring from gate mode to differential impulse sweeping is clearly seen in the peak shift between the two traces. The inserts 100 in FIG. 7 shows the improvement in the resolution that is achieved through the shorter pulses that are produced in differential impulse sweeping. For comparison, the ion peaks of traces (a) and (b) are overlayed and expanded. The wider peak acquired in gate mode shows the expected time resolution of 5 bins or 100 nanoseconds. This width is reduced to 2 bins or 40 nanoseconds for the differential impulse sweep spectrum, which is an improvement by a factor of 2.5 in mass resolution. The small feature at bin 44 in the expansion comes from the $^{15}N$ (and $^{13}C$) isotopes and shows the expected abundance of about 10%. The fill width half maximum resolution at 130 m/z (the major peak) is found to be 338 in gate mode and 845 in differential impulse sweep mode.

Figure 8A:
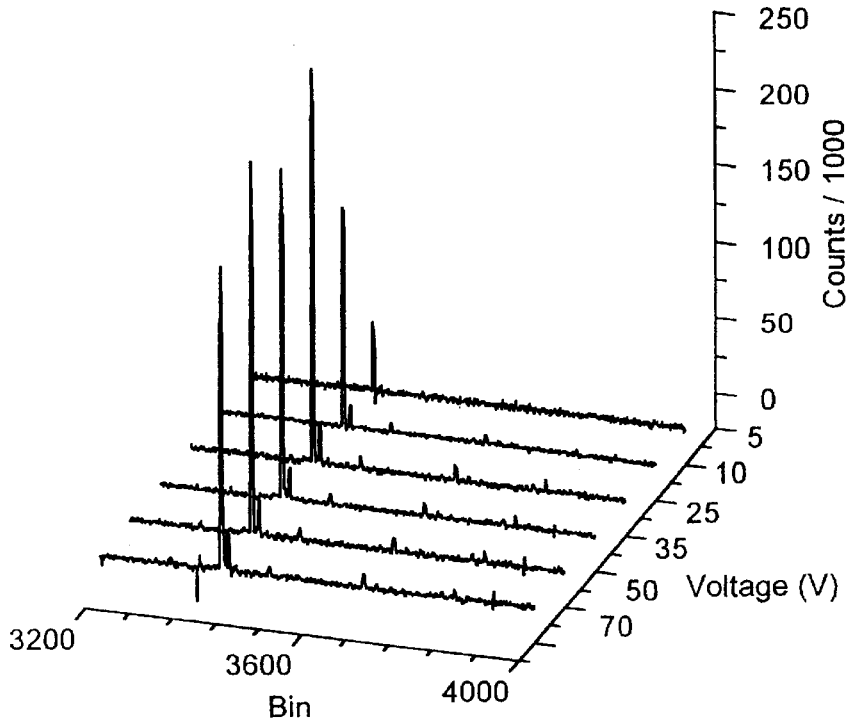
FIG. 8(*a*) is a graphical plot of the mass spectrum obtained at different modulation voltages in a gate mode operation.
Figure 8B:
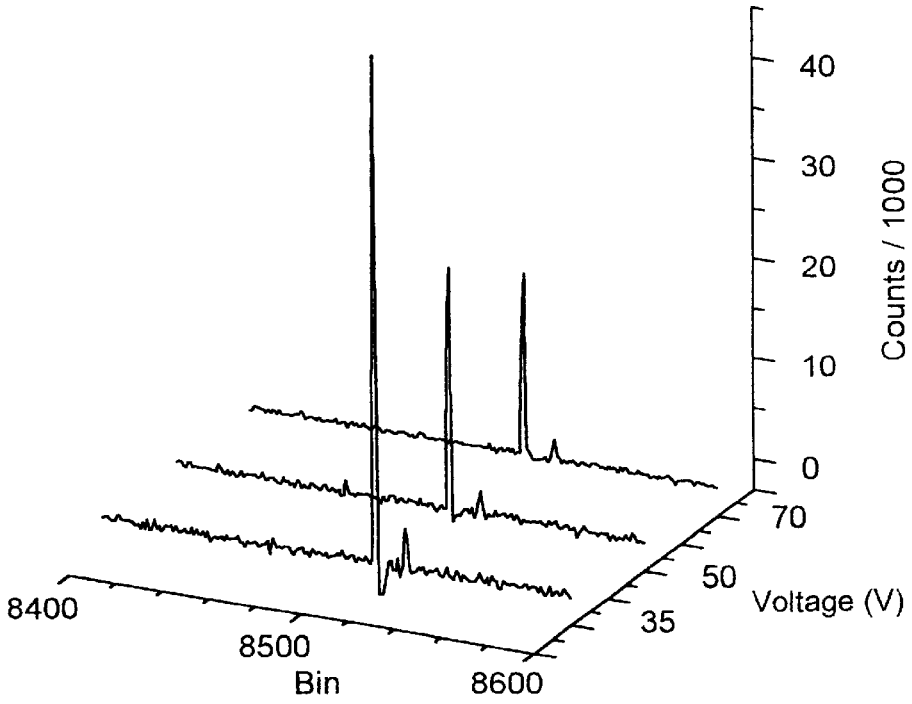

FIGS. 8(*a*) and 8(*b*) show the change in spectral appearance as the modulation voltage is increased when the instrument is operated in a gate mode and the differential impulse sweep mode respectively. Further description of the figures can be found in the appendix.

Figure 9A:
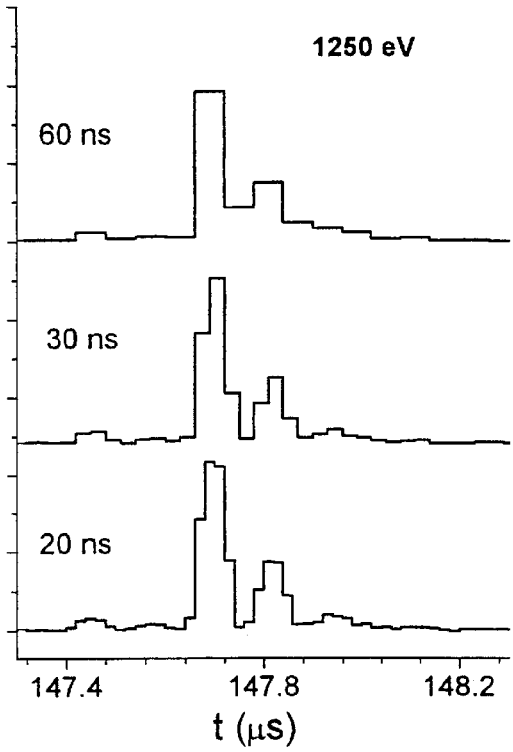
FIG. 9(*a*) is a graphical plot of the mass spectrum of reserpine recorded at beam energies of 1250 eV and at different sampling bin widths in a gate operating mode.
Figure 9B:
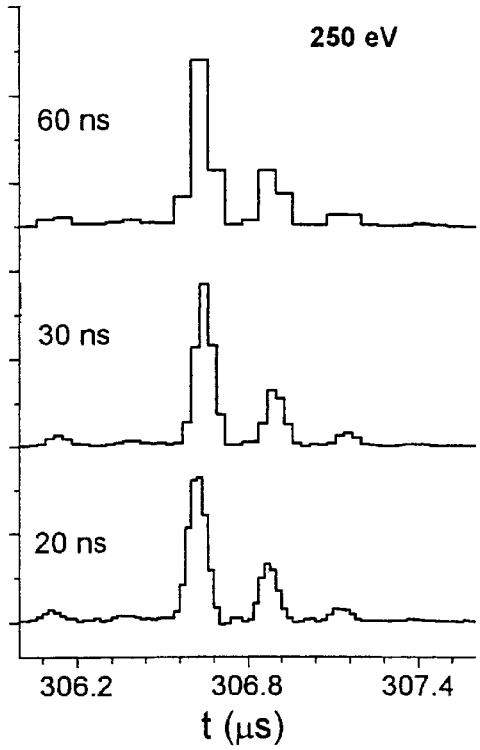

FIGS. 9(*a*) and 9(*b*) show two series of spectra of reserpine recorded at beam energies of 1250 eV and 250 eV, respectively. Details of the experiments yielding the results in the figures can be found in the Appendix. The spectra show that an increase in the sampling rate does not increase the time resolution and mass resolution. The peak definition, however, is improved to higher sampling rates, which allows a more accurate location of the peak maximum and a better mass accurately to be achieved. FIGS. 9(*a*) and 9(*b*), also show that the isotope cluster is resolved. The full-width half-maximum resolution at 250 eV is 1980 which is almost twice the value (1044) measured at 1250 eV energy.

Figure 10B:
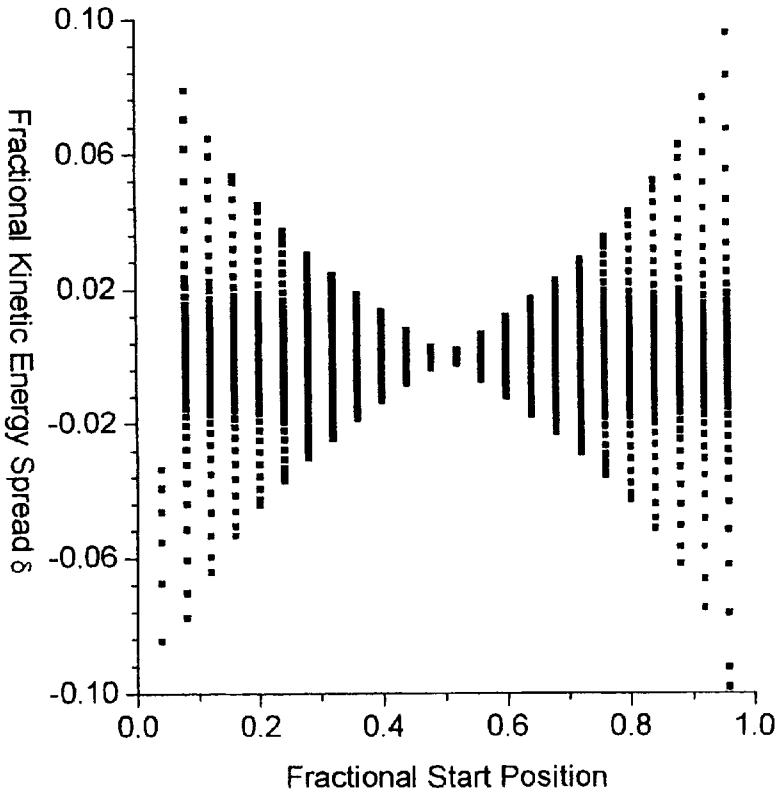
FIGS. 10(*a*) and 10(*b*) are graphical plots of fractional spread in beam energy as a function of the initial position for ions of 10 m/z and 1000 m/z respectively.
Figure 10A:
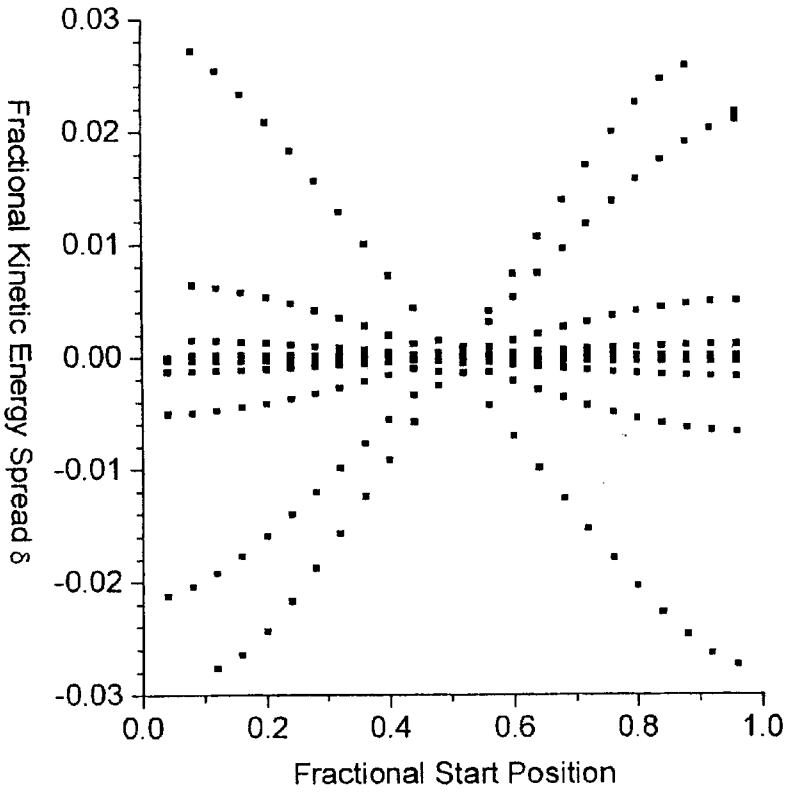
Figure 11B:
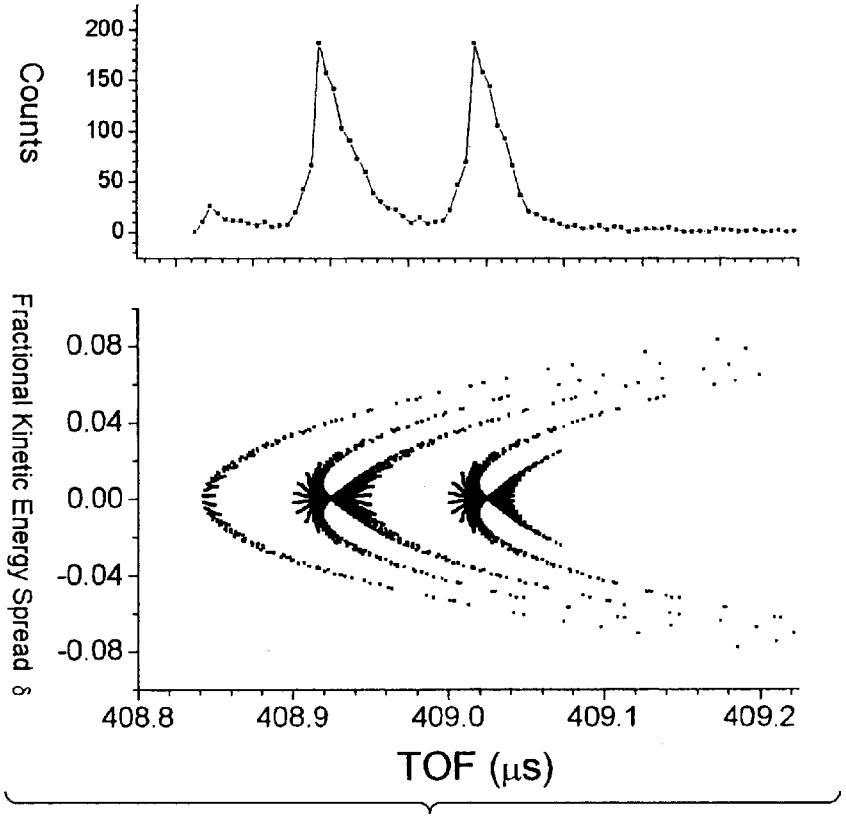
FIGS. 11(*a*) and 11(*b*) show the fractional kinetic energy spread as a function of the flight time through the simulated single-state reflectron instrument as well as the bin arrival time distribution for m/z of 10 and 1000, respectively.
Figure 11A:
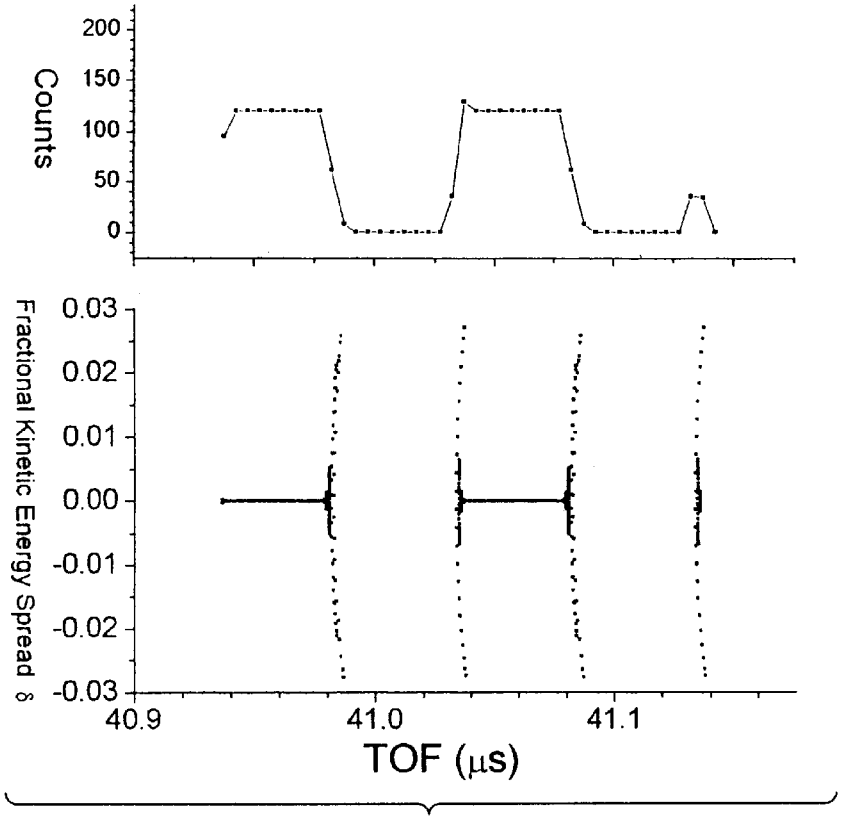
Figure 12:
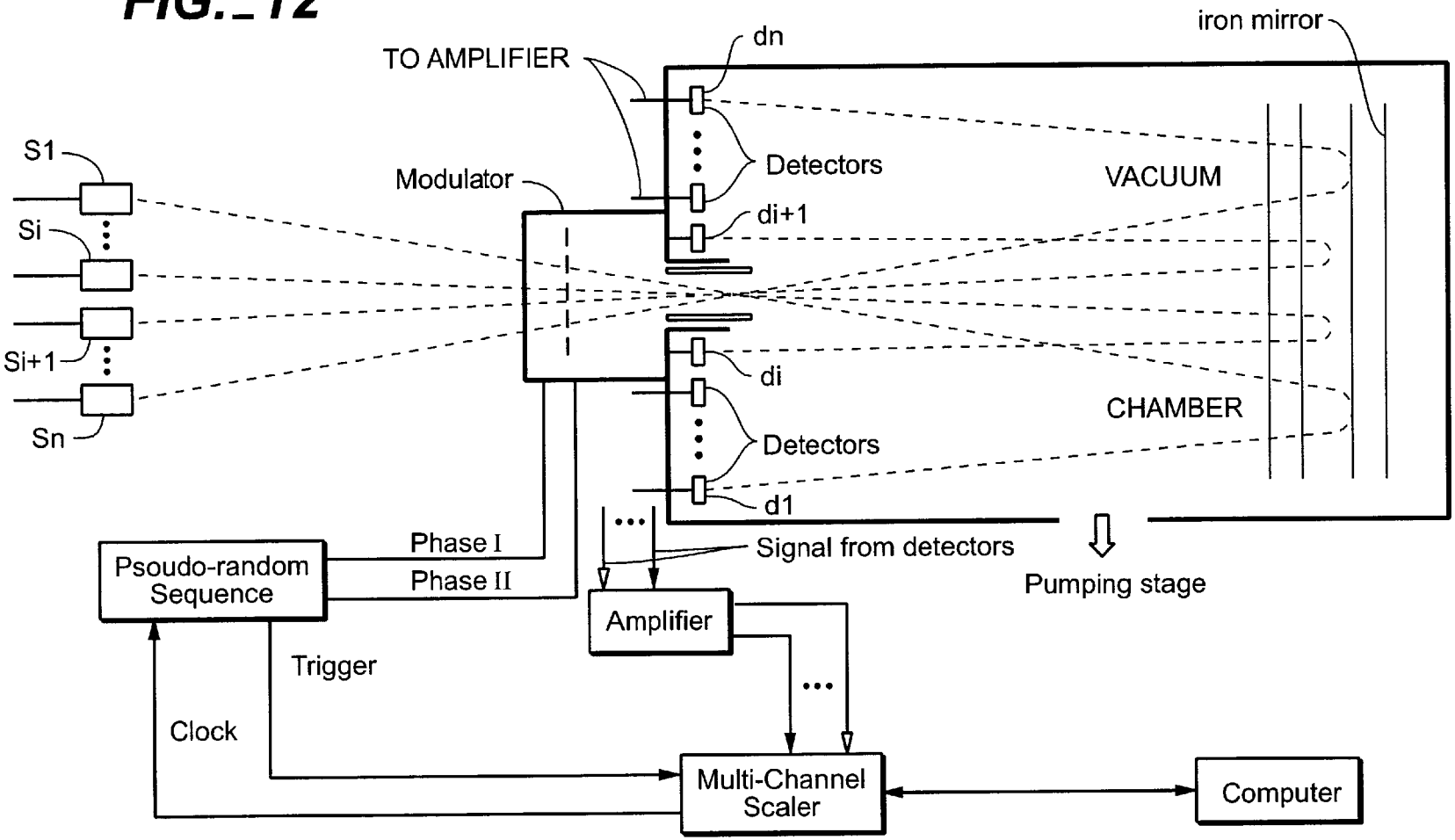
FIG. 12 is is a block diagram of a TOFMS apparatus to illustrate another embodiment of the invention, where multiple TOFMS share a common modulator and chamber.

FIGS. 10(*a*) and 10(*b*) show parts of the fractional spread in beam kinetic energy as a function of pass position between modulator wires and FIGS. 11(*a*) and 11(*b*) show the fractional kinetic energy spread as a function of the flight time through the instrument 20. A detailed description in these figures can be found in the Appendix. Major considerations in analytical instrumentation are space and cost. For these reasons, it may be desirable to provide an apparatus with a plurality of HT-TOFMS systems within the same vacuum chamber, reducing space requirements and cost as compared to the same number of individual mass spectrometers, at the same time. A possible embodiment of such an apparatus is shown in FIG. 12, where multiple systems share the same vacuum chamber. The ion beams entering the common vacuum housing are arranged more or less in parallel, although other arrangements are possible. In this arrangement each of the HT-TOFMS systems is comprises of an ion source $S_i$, where i ranges from 1 to n, n being the total number of systems occupying the same housing, a modulator, an ion mirror, a detector $d_i$, and a wave form recorder. Besides sharing the vacuum envelope, the modulator and the ion mirror are also shared in this arrangement. The ion sources $S_i$ are not necessarily of the same type or use the same ionization mechanism to create the n individual ion streams. The embodiment in FIG. 12 achieves also economy in the necessary pumping capacity to maintain the vacuum in the shared time-of-flight region, because all the beams enter through the same hole into the vacuum chamber. The ion beam from ion source $S_i$, will be directed ions from source $S_i$, will be directed towards detector $d_i$. As seen in FIG. 12, all of the n beams are modulated by the same modulator, which is controlled by the pseudorandom sequence generator in the same manner as was described above in reference to FIG. 3. The n outputs of detectors $d_i$, are simultaneously, but separately recorded by a single wave form recorder having n inputs or multiple wave form recorders providing the proper number of inputs, after having likewise been amplified. Synchronization of modulation and data acquisition is achieved in the same fashion as described in reference to FIG. 3. A single computer is sufficient to control data acquisition and collection, as well as to transform the n signal waveforms into n spectra. In this manner, the ions from a plurality of sources may be analyzed simultaneously and only a single vacuum chamber may be used for housing the systems. While preferably all of the ion beams from the plurality of sources are passed through the same hole and are modulated by the same modulator, it will be understood that the different ion beams can pass through separate holes with each beam being modulated by a dedicated modulator only used for modulating such beam.

While the invention has been described above by reference to various embodiments, it will be understood that changes and modifications may be made without departing from the scope of the invention, which is to be defined only by the appended claims and their equivalents. Thus, while in the preferred embodiment, a source providing ions at constant flux is used, it may also possible to employ other types of sources. The modulator can be controlled so that during the on period or at least a portion thereof, the modulated beam has a substantially constant flux.

What is claimed is:

1. A method for analyzing ions by determining times of flight of the ions, comprising:

providing a continuous beam of ions of substantially constant flux;

modulating the beam by passing the beam substantially unaltered during on periods and affecting the beam during off periods according to a binary sequence to encode the beam with phase information of the binary sequence;

detecting the times of arrival of ions in the modulated beam at a detector, wherein ions passed during at least two consecutive on periods overlap prior to reaching the detector, said detector supplying an output signal in response to the modulated beam; and demodulating the output signal using said phase information to obtain an ion mass spectrum.

2. The method of claim 1, wherein said modulating includes passing the beam through a grid structure and applying to the grid structure a sequence of voltages corresponding to the binary sequence.

3. The method of claim 2, wherein the sequence of voltages causes the beam to be undeflected during said on periods, and to be deflected during the off periods.

4. The method of claim 3, wherein said detector is located so that when the beam is undeflected, the ions in the beam are directed to a first active area of the detector, and when the beam is deflected during the off periods, the beam is directed away from the first active area of the detector.

5. The method of claim 4, wherein when the beam is deflected during the off periods, the beam is directed towards at least a second active area of the detector or another detector.

6. The method of claim 2, said grid structure comprising an array of elongated electrical conductors in a plane, wherein said modulating causes said conductors to be substantially at the same electrical potential during the on periods, and causes the conductors to be at different electrical potentials during the off periods.

7. The method of claim 6, wherein said modulating causes the electrical potentials of each pair of adjacent conductors during the off periods to be different.

8. The method of claim 7, wherein said modulating causes the electrical potentials of each pair of adjacent conductors during the off periods to be of equal amplitude but of opposite polarity.

9. The method of claim 7, wherein said modulating causes the electrical potentials of the conductors of each pair of adjacent conductors to toggle in opposite phase between two electrical potentials.

10. The method of claim 7, wherein said modulating causes the electrical potentials of only one conductor of each pair of adjacent conductors to toggle between two electrical potentials.

11. The method of claim 1, wherein said demodulating includes sampling the output signal during subperiods that are integer fractions of the on periods.

12. The method of claim 1, wherein said demodulating includes forming a correlation matrix from said encoded sequence, and deconvolving said output signal with said matrix to obtain the mass spectrum.

13. The method of claim 1, wherein said demodulating includes performing a Hadamard transform on the output signal to obtain the mass spectrum.

14. An apparatus for analyzing ions by determining times of flight of the ions, comprising:

an ion source providing a continuous beam of ions of substantially constant flux;

a modulator modulating the beam by passing the beam substantially unaltered during on periods and affecting the beam during off periods according to a binary sequence to encode the beam with phase information of the binary sequence;

a detector detecting the times of arrival of ions in the modulated beam, wherein ions passed during at least two consecutive on periods overlap prior to reaching the detector, said detector supplying an output signal in response to the modulated beam; and a processor demodulating the output signal using said phase information to obtain an ion mass spectrum.

15. The apparatus of claim 14, wherein said modulator includes a grid structure that acts to gate the beam by passing the ions in the beam undeflected during on periods or deflecting the ions in the beam during off periods, and a power source supplying to the grid structure a sequence of signals corresponding to the binary sequence to modulate the beam.

16. The apparatus of claim 15, wherein said grid structure includes an array of elongated electrical conductors arranged substantially in a plane.

17. The apparatus of claim 16, wherein said plane is substantially perpendicular to the beam.

18. The apparatus of claim 16, wherein said modulator causes said conductors to be substantially at the same electrical potential during the on periods, and causes the conductors to be at different electrical potentials during the off periods.

19. The apparatus of claim 18, wherein said modulator causes the electrical potentials of each pair of adjacent conductors during the off periods to be different.

20. The apparatus of claim 19, wherein said modulator causes the electrical potentials of each pair of adjacent conductors during the off periods to be of equal amplitude but of opposite polarity.

21. The apparatus of claim 19, wherein said modulator causes the electrical potentials of the conductors of each pair of adjacent conductors to toggle at opposite phase between two electrical potentials.

22. The apparatus of claim 19, wherein said modulator causes the electrical potentials of only one conductor of each pair of adjacent conductors to toggle between two electrical potentials.

23. The apparatus of claim 15, wherein the sequence of signals causes the beam to be undeflected during said on periods, and to be deflected during the off periods.

24. The apparatus of claim 23, said detector having a first active area, wherein said detector is located so that when the beam is undeflected, the ions in the beam are directed to the first active area of the detector, and when the beam is deflected during the off periods, the beam is directed away from the first active area of the detector.

25. The apparatus of claim 24, said detector having at least a second active area, wherein when the beam is deflected during the off periods, the beam is directed towards the at least second active area of the detector or another detector.

26. The apparatus of claim 14, wherein said processor samples the output signal during subperiods that are integer fractions of the on periods.

27. The apparatus of claim 14, wherein said processor forms a correlation matrix from said binary sequence, and deconvolving said output signal with said matrix to obtain the mass spectrum.

28. The apparatus of claim 14, wherein said processor performs a Hadamard transform on the output signal to obtain the mass spectrum.

29. An apparatus for analyzing ions by determining times of flight of the ions, comprising:

means for providing a continuous beam of ions of substantially constant flux;

means for modulating the beam by passing the beam substantially unaltered during on periods and affecting the beam during off periods according to a binary sequence to encode the beam with phase information of the binary sequence;

means for detecting the times of arrival of ions in the modulated beam at a detector, wherein ions passed during at least two consecutive on periods overlap prior to reaching the detector, said detector supplying an output signal in response to the modulated beam; and means for demodulating the output signal using said phase information to obtain an ion mass spectrum.

30. An apparatus for analyzing ions by determining times of flight of the ions, comprising:

a plurality of ion sources, each providing a continuous beam of ions of substantially constant flux along one of a plurality of distinct paths;

a chamber housing said paths;

a modulator modulating the beams by passing the beams substantially unaltered during on periods and affecting the beams during off periods according to a binary sequence to encode each of said beams with phase information of the binary sequence;

a plurality of detectors, each detector corresponding to a modulated beam, each detector supplying an output signal in response to the times of arrival of the corresponding modulated beam, wherein ions in each modulated beam passed during at least two consecutive on periods overlap prior to reaching the detector; and a processor demodulating each of the output signals with the phase information to obtain ion mass spectra of the beams.

31. An apparatus for analyzing ions by determining times of flight of the ions, comprising:

a source providing a continuous beam of ions;

a modulator modulating the beam by passing the beam substantially unaltered during on periods and affecting the beam during off periods according to an encoding sequence, wherein said modulated beam has a substantially constant flux during at least one portion of the on periods;

a detector detecting the times of arrival of ions in the modulated beam at a detector, wherein ions in the modulated beam passing during at least two consecutive on periods overlap prior to reaching the detector, said detector supplying an output signal in response to the modulated beam; and a processor demodulating the output signal using said encoding sequence to obtain an ion mass spectrum.

32. The apparatus of claim 31, wherein said modulated beam has a substantially constant flux during the on periods.

* * * * *